US007044404B1

(12) United States Patent
Kricheldorf

(10) Patent No.: US 7,044,404 B1
(45) Date of Patent: May 16, 2006

(54) PNEUMATIC LIQUID-DELIVERY DEVICE

(76) Inventor: Michael A. Kricheldorf, 1315 Dover Pl., Lynchburg, VA (US) 24502

( * ) Notice: Subject to any disclaimer, the term of this patent is extended or adjusted under 35 U.S.C. 154(b) by 163 days.

(21) Appl. No.: 10/800,434

(22) Filed: Mar. 15, 2004

(51) Int. Cl.
*B05B 7/02* (2006.01)

(52) U.S. Cl. ..... 239/525; 239/1; 239/71; 239/74; 239/337; 239/346; 239/351; 239/373; 239/375; 239/583; 239/586; 222/465.1; 222/470; 222/472; 222/473; 222/474; 222/157; 222/373; 222/394; 222/399; 222/389; 169/71; 169/85; 169/88; 137/206; 137/209

(58) Field of Classification Search ..... 239/1, 239/71, 74, 337, 346, 351, 373; 137/206, 137/209; 222/373, 389, 394, 399, 470, 472, 222/473, 474, 465.1; 169/71, 85, 88
See application file for complete search history.

(56) References Cited

U.S. PATENT DOCUMENTS

| | | | | | |
|---|---|---|---|---|---|
| 587,099 | A | | 7/1897 | Lev | |
| 688,261 | A | * | 12/1901 | Parks | 239/142 |
| 938,517 | A | | 11/1909 | Schmitt | |
| 1,246,213 | A | * | 11/1917 | Zawels | 222/401 |
| 1,266,396 | A | * | 5/1918 | Brown | 222/473 |
| 1,646,567 | A | * | 10/1927 | Weber | 222/250 |
| 1,707,425 | A | * | 4/1929 | Baker | 222/135 |
| 1,843,532 | A | * | 2/1932 | Willson | 222/394 |
| 2,261,834 | A | | 11/1941 | Morgan | |
| 2,378,451 | A | * | 6/1945 | Vensel | 239/337 |
| 2,723,161 | A | * | 11/1955 | Covington | 222/386.5 |
| 2,753,080 | A | * | 7/1956 | Bartlett | 222/82 |
| 3,603,694 | A | * | 9/1971 | Hamm | 401/150 |
| D272,380 | S | * | 1/1984 | Poon | D23/225 |
| 4,700,861 | A | | 10/1987 | Neward | |
| 4,971,257 | A | * | 11/1990 | Birge | 239/708 |
| 5,186,362 | A | | 2/1993 | Biagi, Jr. | |
| 5,570,813 | A | | 11/1996 | Clark, II | |
| D387,270 | S | * | 12/1997 | Bifulco | D9/600 |
| 5,873,500 | A | | 2/1999 | Homburg et al. | |
| 6,233,933 | B1 | * | 5/2001 | Petty | 60/584 |
| 6,415,956 | B1 | * | 7/2002 | Havlovitz | 222/109 |
| 6,494,347 | B1 | * | 12/2002 | Yeh | 222/262 |
| 6,508,410 | B1 | * | 1/2003 | Thomas et al. | 239/1 |
| 6,824,076 | B1 | * | 11/2004 | Harris | 239/311 |
| 6,857,543 | B1 | * | 2/2005 | Kvam et al. | 222/571 |

FOREIGN PATENT DOCUMENTS

| | | | | |
|---|---|---|---|---|
| DE | 1020577 | * | 12/1957 | 239/373 |
| FR | 1404299 | * | 5/1965 | 239/373 |
| IT | 463923 | * | 7/1951 | 239/346 |

* cited by examiner

*Primary Examiner*—David Scherbel

(57) ABSTRACT

A fluid delivery device for supplying fluids, particularly automotive fluids supplied to fluid reservoirs. To attain this, a vessel configured to hold a liquid includes a pressurized gas inlet configured to receive gas into the vessel through a passageway in an integral handle upon actuation of a handle-mounted trigger. Liquid is displaced from the vessel by the gas. In an embodiment, the trigger includes a stem having a solid portion and a hollow portion, and actuation of the trigger aligns the hollow portion with the passageway such that gas may flow. Liquid flows through a hose extending from the vessel.

19 Claims, 4 Drawing Sheets

PNEUMATIC LIQUID-DELIVERY DEVICE

BACKGROUND OF THE INVENTION

1. Field of the Invention

The present invention relates to a pneumatic fluid delivery system for use in connection with filling fluid reservoirs. The pneumatic fluid delivery system has particular utility in connection with filling automotive fluid reservoirs.

2. Description of the Related Art

Pneumatic fluid delivery systems are desirable for supplying liquids into reservoirs that may be difficult to reach or fill without spilling the liquid if conventional pouring must be used.

The use of fluid delivery systems is known in the prior art. For example, U.S. Pat. No. 5,873,500 to Homburg et al. discloses a fluid delivery cart designed to be used to deliver fluid to aircraft. However, the Homburg et al. '500 patent does not disclose a pneumatic fluid delivery system having a vessel with an integral handle, wherein the handle includes a hollow passageway through which a gas passes to enter the vessel as claimed in the instant application.

Similarly, U.S. Pat. No. 5,186,362 to Biagi, Jr. discloses a liquid transfer assembly that includes a vessel having a stopper-type closure through which a plurality of tubes may be directed, one of which may receive a gas while another of which may supply a liquid. However, the Biagi, Jr. '362 patent does not disclose a pneumatic fluid delivery system having a vessel with an integral handle, wherein the handle includes a hollow passageway through which a gas passes to enter the vessel as claimed in the instant application.

Similarly, U.S. Pat. No. 587,099 to Levi discloses a preserving siphon that appears to receive a carbonic acid through vessel cap, where the vessel cap includes a spigot for dispensing a liquid held in the vessel. However, the Levi '099 patent does not disclose a pneumatic fluid delivery system having a vessel with an integral handle, wherein the handle includes a hollow passageway through which a gas passes to enter the vessel as claimed in the instant application.

Similarly, U.S. Pat. No. 938,517 to Schmitt discloses a beverage siphon that appears to receive a gas through a vessel lid, where the vessel lid includes a spigot or outlet for dispensing a liquid held in the vessel. However, the Schmitt '517 patent does not disclose a pneumatic fluid delivery system having a vessel with an integral handle, wherein the handle includes a hollow passageway through which a gas passes to enter the vessel as claimed in the instant application.

Similarly, U.S. Pat. No. 2,261,834 to Morgan discloses a grease dispensing apparatus that includes a cylindrical grease-holding vessel having a disc arranged therein, where the disc is arranged between a grease-outlet and a fluid-input where fluid is inputted into the vessel so as to move the disc and displace the grease through the grease-outlet. However, the Morgan '834 patent does not disclose a pneumatic fluid delivery system having a vessel with an integral handle, wherein the handle includes a hollow passageway through which a gas passes to enter the vessel as claimed in the instant application.

Similarly, United States Design Pat. No. D387,270 to Bifulco appears to disclose a design for a portable mister. However, the Bifulco '270 patent does not appear to disclose not disclose a pneumatic fluid delivery system having a vessel with an integral handle, wherein the handle includes a hollow passageway through which a gas passes to enter the vessel as claimed in the instant application.

U.S. Pat. No. 4,700,861 to Neward discloses a container cap for liquid transfer that provides an air-tight seal around a fluid transfer conduit. However, the Neward '861 patent does not disclose a pneumatic fluid delivery system having a vessel with an integral handle, wherein the handle includes a hollow passageway through which a gas passes to enter the vessel as claimed in the instant application.

Lastly, U.S. Pat. No. 5,570,813 to Clark, II discloses a viscous material delivery and management system for delivering viscous materials that has a sealed container holding viscous material, a source of gas in gaseous communication with the container, and a viscous material delivery conduit in communication with the container. However, the Clark,II '813 patent does not disclose a pneumatic fluid delivery system having a vessel with an integral handle, wherein the handle includes a hollow passageway through which a gas passes to enter the vessel as claimed in the instant application.

While the above-described devices fulfill their respective, particular objectives and requirements, the aforementioned patents do not describe a pneumatic fluid delivery system that allows the handle to include a hollow passageway through which a gas passes to enter a vessel as claimed in the instant application. Such a fluid delivery system has the advantage of being hand-held and easily handled such that delivering fluids is facilitated.

Therefore, a need exists for a new and improved pneumatic fluid delivery system which can be used for supplying liquids into reservoirs that may be difficult to access. In this regard, the present invention substantially fulfills this need. In this respect, the pneumatic fluid delivery system according to the present invention substantially departs from the conventional concepts and designs of the prior art, and in doing so provides an apparatus primarily developed for the purpose of supplying liquids.

SUMMARY OF THE INVENTION

In view of the foregoing disadvantages inherent in the known types of fluid delivery systems now present in the prior art, the present invention provides an improved pneumatic fluid delivery system, and overcomes the above-mentioned disadvantages and drawbacks of the prior art. As such, the general purpose of the present invention, which will be described subsequently in greater detail, is to provide a new and improved pneumatic fluid delivery system and method of dispensing a fluid which has all the advantages of the prior art mentioned heretofore and many novel features that result in a pneumatic fluid delivery system which is not anticipated, rendered obvious, suggested, or even implied by the prior art, either alone or in any combination thereof.

To attain this, the present invention essentially comprises a container configured to hold a liquid, where the container includes an inlet to receive a pressurized gas; an integral handle having a pneumatic fitting and a hollow passageway; and a trigger that opens the passageway between the pneumatic fitting and the inlet when actuated, thus allowing the pressurized gas to displace the liquid.

Also, the present invention essentially comprises a container accommodating approximately five liters and made from a high strength plastic, where the container includes a handle designed to be held approximately vertical in a user's hand, and where the handle is able to support the weight of the full vessel; a compressed gas fitting arranged on the handle; a trigger pivotably coupled to the handle; a compressed gas inlet arranged within the vessel; and a compressed gas passageway arranged in and through the handle, where compressed gas is supplied through the compressed gas passageway from the fitting to the inlet when the trigger is actuated.

There has thus been outlined, rather broadly, the more important features of the invention in order that the detailed description thereof that follows may be better understood and in order that the present contribution to the art may be better appreciated.

The invention may also include a pressure regulator or a sight window. There are, of course, additional features of the invention that will be described hereinafter and which will form the subject matter of the claims attached.

Numerous objects, features and advantages of the present invention will be readily apparent to those of ordinary skill in the art upon a reading of the following detailed description of presently preferred, but nonetheless illustrative, embodiments of the present invention when taken in conjunction with the accompanying drawings. In this respect, before explaining the current embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved pneumatic fluid delivery system that has all of the advantages of the prior art fluid delivery systems and none of the disadvantages.

It is another object of the present invention to provide a new and improved pneumatic fluid delivery system that may be easily and efficiently manufactured and marketed.

An even further object of the present invention is to provide a new and improved pneumatic fluid delivery system that has a low cost of manufacture with regard to both materials and labor, and which accordingly is then susceptible of low prices of sale to the consuming public, thereby making such pneumatic fluid delivery system economically available to the buying public.

Still another object of the present invention is to provide a new pneumatic fluid delivery system that provides in the apparatuses and methods of the prior art some of the advantages thereof, while simultaneously overcoming some of the disadvantages normally associated therewith.

Even still another object of the present invention is to provide a pneumatic fluid delivery system for supplying fluids to engine or automotive reservoirs.

Still yet another object of the present invention is to provide a pneumatic fluid delivery system for eliminating the need to pour fluids.

Lastly, it is an object of the present invention to provide a new and improved method of dispensing a fluid.

These together with other objects of the invention, along with the various features of novelty that characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is an illustrated preferred embodiment of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various figures.

Figure 1:
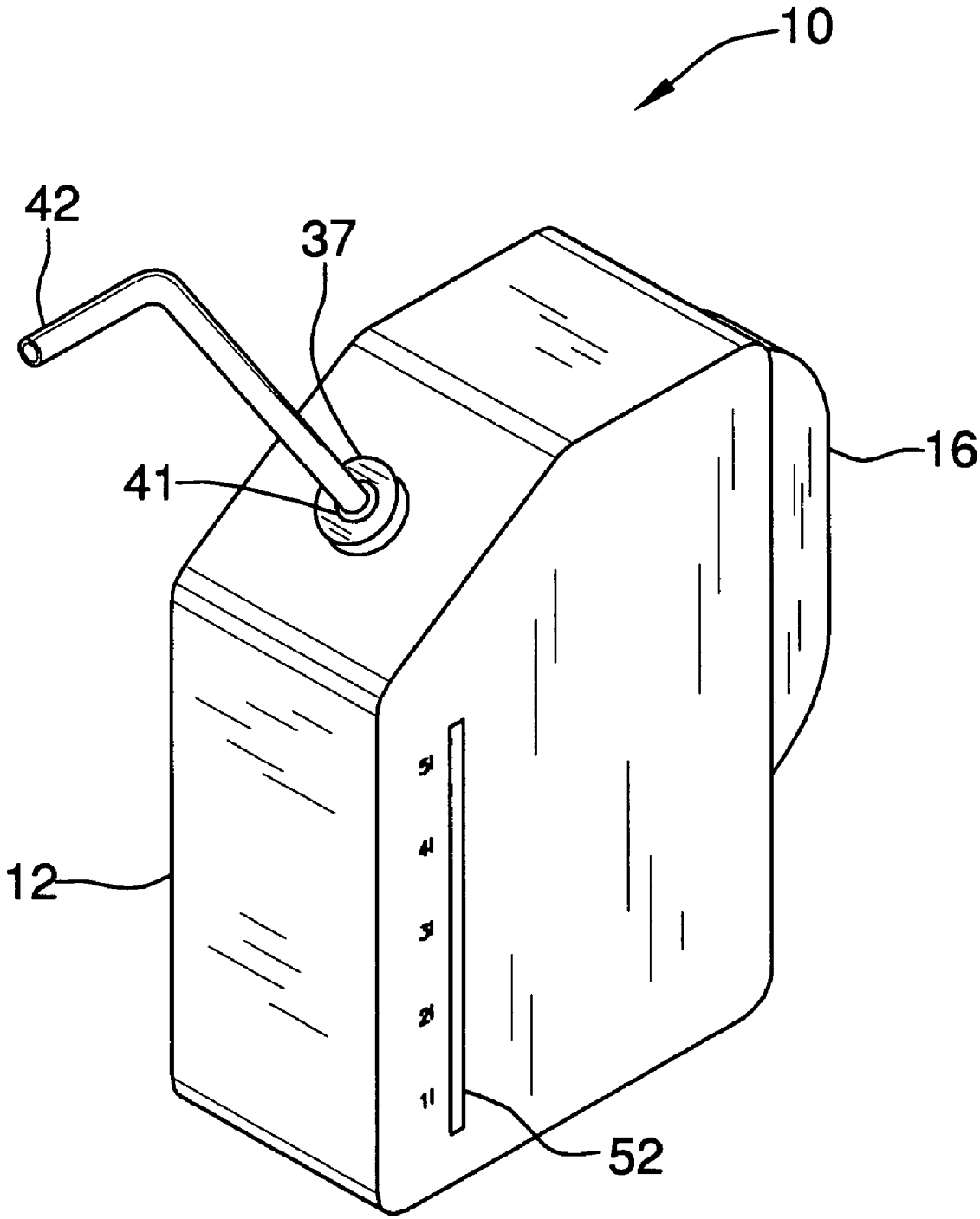
FIG. 1 is an oblique view of an embodiment of the apparatus of the present invention.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

DETAILED DESCRIPTION OF PREFERRED EMBODIMENTS

Referring now to the drawings, and particularly to FIGS. 1–4, a preferred embodiment of the pneumatic fluid delivery system of the present invention is shown and generally designated by the reference numeral 10.

In FIG. 1, a new and improved pneumatic fluid delivery system 10 of the present invention for delivering fluids is illustrated and will be described. More particularly, the pneumatic fluid delivery system includes a vessel 12 having an integrated handle 16. The vessel is constructed from a substantially unbreakable and shatterproof material. Furthermore, the vessel is constructed from a a material that is rigid as well as oil and heat resistant. Of course, the vessel must be constructed from a material and in a manner that will allow it to withstand a higher pressure than what is necessary to displace fluid from the vessel using a compressed gas. In the preferred embodiment, the vessel is constructed from a high density plastic. However, the vessel may also be constructed from other materials, such as, for example, a composite material or a metal. The vessel may be of any number of sizes, but in the preferred embodiment the vessel is configured to hold at least approximately five liters and the vessel is opaque. In an embodiment, the vessel may include a fill window 52, such that the contents may be monitored. The fill window may be a sight window, where the actual contents are viewed, or the fill window may also be some other type of fluid level determining device which allows the user to ascertain the fluid level. The opening of the vessel 12 may be fitted with a cap 37, where the cap includes an opening therethrough from which extends a hose 42. The cap 37 may be fitted with a gasket 41 arranged about the hose 42 such that an airtight seal is formed.

Figure 2:
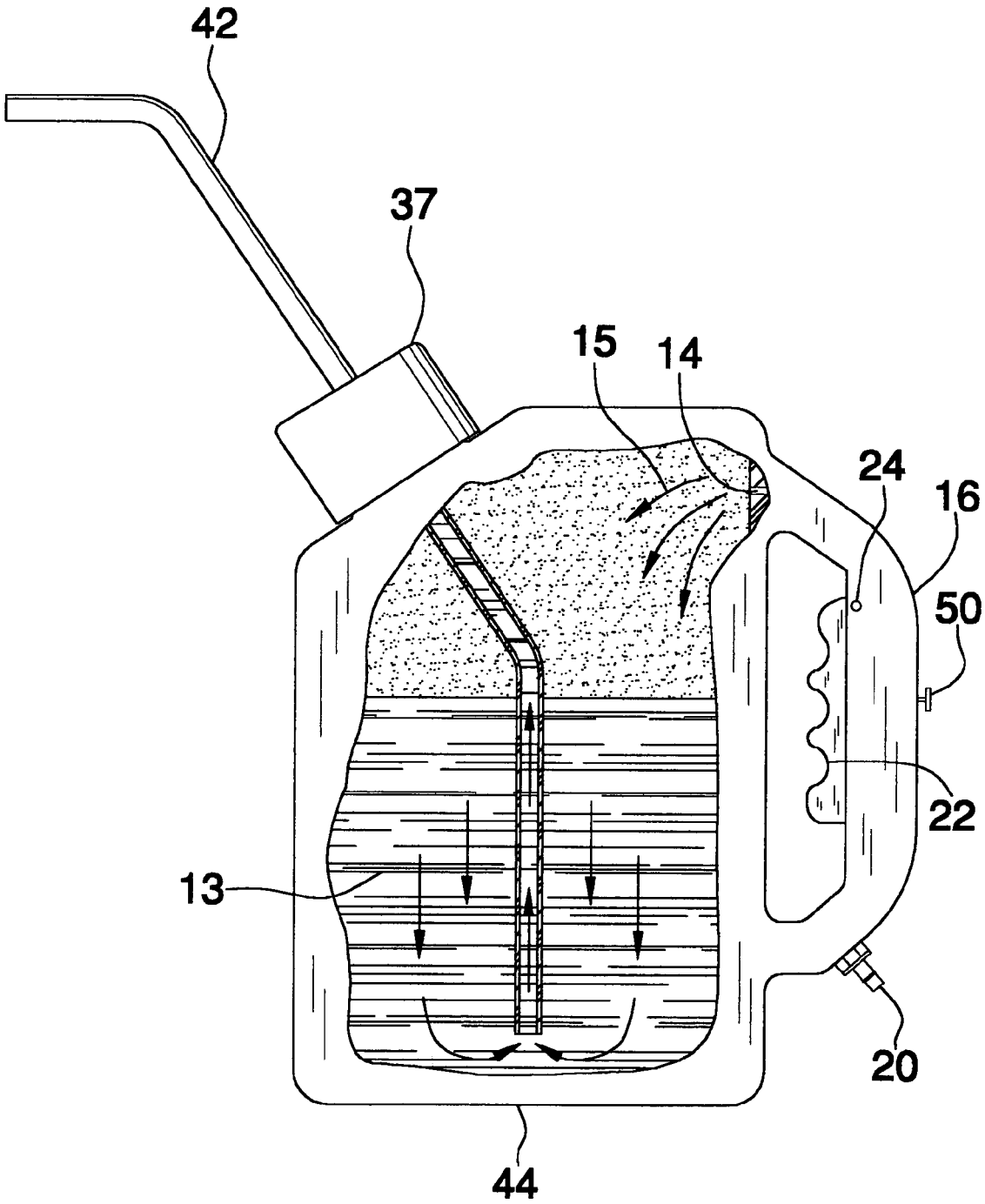
FIG. 2 is an oblique, cut-away view of an embodiment of the apparatus of the present invention.

Turning to FIG. 2, a cut-away view of the preferred embodiment is shown and will be described. As noted previously, the vessel 12 includes an integral handle 16. Arranged upon the handle 16 is a fitting 20. Fitting 20 is configured to receive a supply of compressed gas. That is, fitting 20 may be a pneumatic fitting. Trigger 22 is connected to the handle 16 at least at pivot point 24. Actuation of the trigger 22 allows the flow of compressed gas from the fitting 20 to the inlet 14, as described in further detail below. Gas flow into the vessel is represented by the arrows 15. Inlet 14 is shown arranged near the top of the vessel 12, yet the inlet may be arranged at any point on the vessel. Hose 42 is constructed from a material that is oil resistant, semi-rigid, and heat resistant. The hose may be clear or opaque, and in a preferred embodiment the hose has an inner diameter of either ½ inch or 13 mm. A distal end of hose 42 extends from the vessel 12, and a proximal end of the hose 42 is arranged very near a lowermost surface of the vessel 44. Gas received into the vessel 12 functions to displace fluid 13, pushing fluid 13 up into hose 42. Should hose 42 become clogged, or if the vessel should otherwise begin to become over-pressurized, a pressure relief valve 50 may be incorporated into the vessel. In the preferred embodiment shown, the pressure relief valve is incorporated into the handle 16. In an embodiment, the air pressure will be about 10 to 15 psi.

Figure 3:
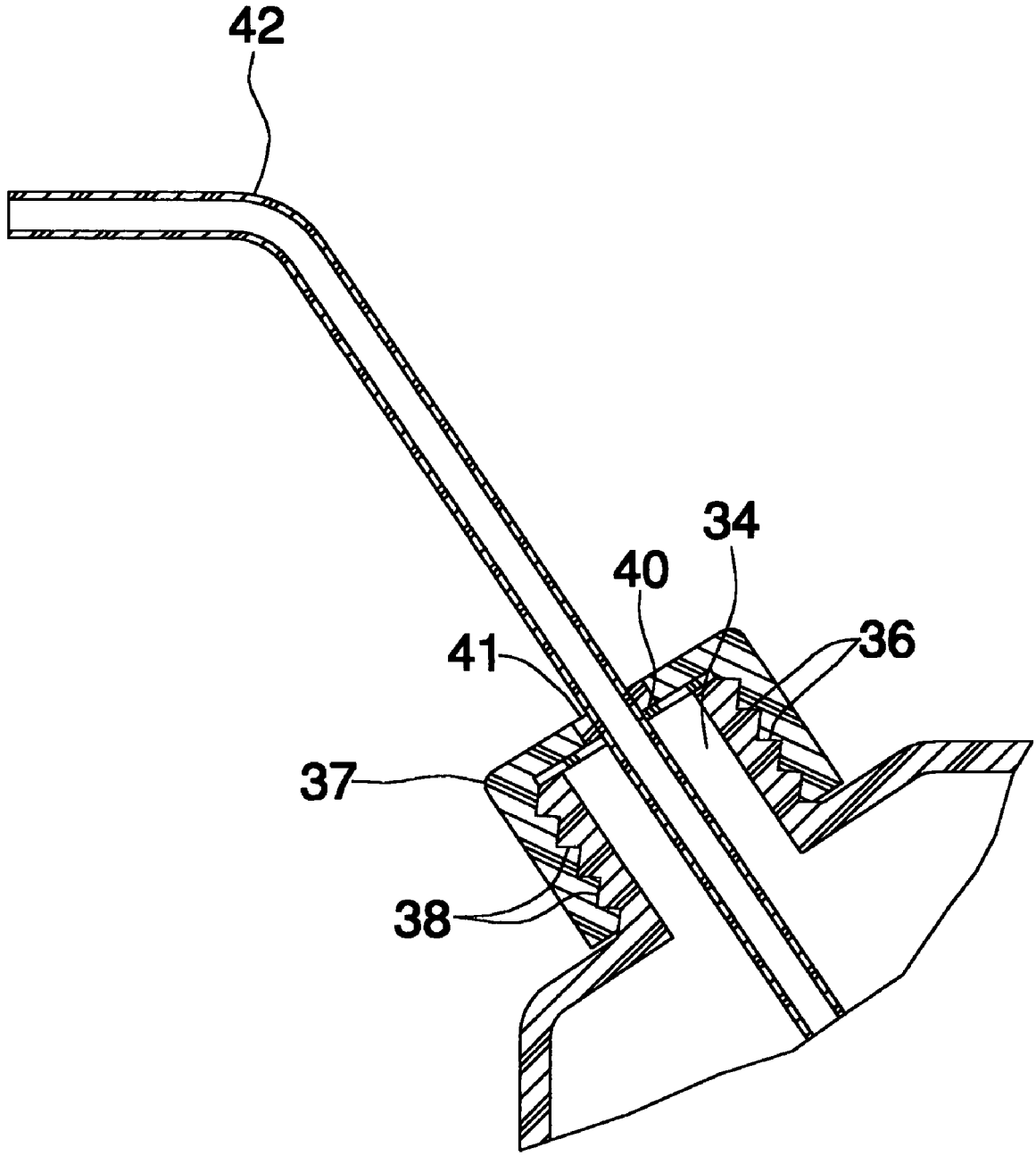
FIG. 3 is a cross-section view of the opening of an embodiment of the apparatus of the present invention.

Turning to FIG. 3, a cross-section of the vessel opening 34 is shown and will be described. In the preferred embodiment shown, the vessel opening 34 is arranged at the top of a stem extending from the body of the vessel. This stem includes threads 36. In the preferred embodiment, these threads are deep so as to provide solid locking action. Arranged upon the vessel opening is a cap 37. This cap 37 has reciprocating deep threads. AS such, the cap is configured to hold tight onto the vessel when the vessel is under significant pressure. The cap includes a hole 40 therethrough, from which extends a hose 42. Arranged within the hole in the cap 40 also exists a gasket 41, providing an air-tight seal around the hose 42. Cap 40, gasket 41, and hose 42 may be fastened together so as to form a single, replaceable part. Alternately, hose 42 may be removable from the cap 40 and gasket 41.

Figure 4:
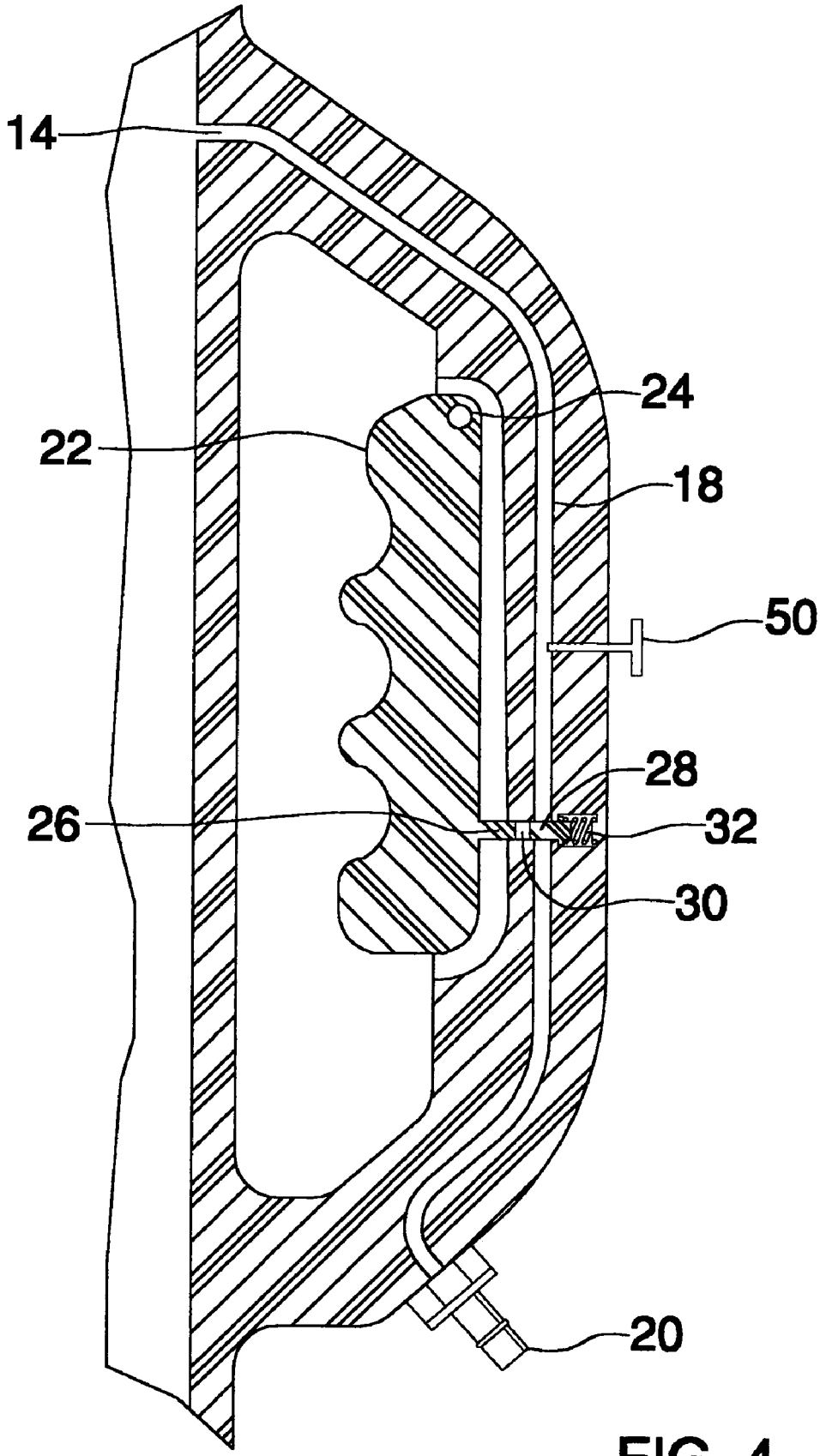
FIG. 4 is a cross-section view of the handle of an embodiment of the apparatus of the present invention.

Turning to FIG. 4, a cross-section of the handle 16 is shown and will be described. The handle 15 includes a fitting 20, as described previously. Fitting 20 is inline with and coupled to a passageway 18. Passageway 18 is the path through which compressed gas travels from the fitting 20 through the inlet 14 and ultimately into the vessel. The compressed gas is supplied when the trigger 22 is actuated. As noted above, the trigger 22 is coupled to the handle at pivot point 24. Extending from the trigger 22 is a stem 26. Stem 26 functions to obstruct the passageway when the trigger is not actuated. That is, when the trigger is not actuated, a spring 32 applies a force to the stem such that the solid portion 28 of the stem 26 obstructs the passageway 18. However, upon actuation, the stem's hollow portion 30 becomes aligned with the passageway 18, thus allowing the compressed gas to flow into the vessel. In the preferred embodiment, the compressed gas is an inert gas, such as nitrogen. However, any type of compressed gas may be used.

In use, a user would remove the cap, and place a fluid inside the vessel. The user would securely replace the cap, and attach a supply of compressed gas onto the fitting. The user would take the vessel by the handle, and place the hose into a reservoir to be filled. The hose may include a fitting on its distal end, where the fitting reciprocates with a fitting on a fluid reservoir. Once the user has placed the hose such that the fluid will dispense into the chosen reservoir, the user actuates a trigger 22 which will allow compressed gas into the vessel where it may displace the fluid into a reservoir.

While a preferred embodiment of the pneumatic fluid delivery system has been described in detail, it should be apparent that modifications and variations thereto are possible, all of which fall within the true spirit and scope of the invention. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention. For example, any suitable sturdy material may be used for the vessel instead of those described. Also, the vessel may be of any size or shape. And although delivering automotive fluids has been described, it should be appreciated that the pneumatic fluid delivery system herein described is also suitable for delivering any number of fluids for any number of applications. Furthermore, a wide variety of compressed gasses may be used instead of the nitrogen described.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A pneumatic liquid-delivery device comprising:

a vessel, wherein the vessel is configured to receive and hold a liquid, and wherein the vessel comprises a pressurized gas inlet;

a handle, wherein the handle is integral with the vessel, wherein the handle comprises a hollow passageway, and wherein the handle comprises a pneumatic fitting; and a trigger, wherein the trigger is fixably coupled to the handle, wherein actuation of the trigger opens the passageway between the pneumatic fitting and the gas inlet, and wherein gas received into the vessel via the gas inlet displaces liquid from the vessel, wherein the trigger comprises a stem, wherein the stem comprises a solid portion and a hollow portion, wherein the solid portion obstructs the passageway when the trigger is not actuated, and wherein the hollow portion aligns with and opens the passageway when the trigger is actuated.

2. The device as recited in claim 1, wherein the trigger is coupled to the handle at a pivot point.

3. The device as recited in claim 1, further comprising a spring, wherein the spring is compressed when the trigger is actuated.

4. The device as recited in claim 3, further comprising an opening, wherein the opening comprises deep threads.

5. The device as recited in claim 4, wherein the threaded opening is configured to reciprocate with a cap, wherein the cap comprises reciprocating deep threads, and wherein the cap comprises a hole therethrough.

6. The device as recited in claim 5, further comprising a dispense hose, wherein the dispense hose extends from adjacent a lowermost surface of the vessel up through the hole in the cap, and wherein displaced liquid travels through the dispense hose.

7. The device as recited in claim 6, wherein the dispense hose is configured with a fluid delivery fitting.

8. The device as recited in claim 7, wherein the fitting is removable and exchangeable.

9. The device as recited in claim 8, wherein the gas inlet is attached to an air compressor.

10. The device as recited in claim 9, wherein the threaded opening is configured to receive a fluid therethrough when the cap is removed, and wherein the cap and hose are positionable on the vessel such that an air-tight seal therebetween is formed, and wherein the fluid dispenses from the dispense hose fluid delivery fitting upon actuation of the trigger.

11. The device as recited in claim 1, further comprising a pressure relief valve.

12. The device as recited in claim 11, wherein the pressure relief valve is arranged on the handle.

13. The device as recited in claim 1, further comprising:

a spring, wherein the spring is compressed when the trigger is actuated;

a threaded opening, wherein the threaded opening is configured to reciprocate with a cap comprising a hole therethrough, wherein the threaded opening comprises deep threads, and wherein the cap comprises reciprocating deep threads;

a dispense hose, wherein the dispense hose extends from adjacent a lowermost surface of the vessel up through the hole in the cap, wherein the dispense hose is configured with an exchangeable fluid delivery fitting, and wherein the cap and hose are positionable on the vessel such that an air-tight seal therebetween is formed, and wherein the fluid dispenses from the hose fluid delivery fitting upon actuation of the trigger; and a pressure relief valve, wherein the pressure relief valve is arranged on the handle.

14. A fluid delivery device comprising:

a vessel, wherein the vessel is constructed from a high strength plastic, and wherein the vessel accommodates approximately five liters;

a handle, wherein the handle is configured to support the weight of the vessel when full, and wherein the handle is designed to be held substantially vertical in a user's hand;

a compressed gas fitting, wherein the fitting is arranged on the handle;

a trigger, wherein the trigger is pivotably coupled to the handle;

a compressed gas inlet, wherein the air inlet is arranged within the vessel; and a compressed gas passageway, wherein the compressed gas passageway is arranged in the handle, and wherein compressed gas is supplied through the compressed gas passageway from the fitting to the inlet when the trigger is actuated, wherein the trigger comprises a stem, wherein the stem comprises a solid portion and a hollow portion, wherein the solid portion obstructs the passageway when the trigger is not actuated, and wherein the hollow portion aligns with and opens the passageway when the trigger is actuated.

15. The device as recited in claim 14, wherein the vessel is configured to withstand high pressure.

16. The device as recited in claim 14, wherein the vessel comprises a sight-fill window.

17. The device as recited in claim 14, further comprising a dispense hose, wherein the dispense hose is configured to transport the fluid from the vessel.

18. The device as recited in claim 17, wherein the hose extends from the vessel thru an air-tight orifice, and wherein the hose comprises an interchangeable fluid delivery fitting.

19. A method of dispensing a fluid, said method comprising:

placing a fluid within a high-strength vessel through an opening in the vessel;

securing a cap on the opening, wherein the cap comprises a hose extending therefrom;

attaching a compressed gas source to a compressed gas inlet on the vessel; and actuating a trigger, wherein the trigger is coupled to a handle integral with the vessel, wherein actuation supplies compressed gas into the vessel through a passageway in the handle, and wherein the compressed gas displaces the fluid, causing the fluid to flow from the vessel through the hose, wherein the trigger comprises a stem, wherein the stem comprises a solid portion and a hollow portion, wherein the solid portion obstructs the passageway when the trigger is not actuated, and wherein the hollow portion aligns with and opens the passageway when the trigger is actuated.

* * * * *